US012460639B2

(12) United States Patent
Holbrook et al.

(10) Patent No.: US 12,460,639 B2
(45) Date of Patent: Nov. 4, 2025

(54) SCROLL PUMP WITH BEARING DIAPHRAGM

(71) Applicant: Edwards Limited, Burgess Hill (GB)

(72) Inventors: Alan Ernest Kinnaird Holbrook, Burgess Hill (GB); Nigel Paul Schofield, Burgess Hill (GB); David Bedwell, Burgess Hill (GB)

(73) Assignee: Edwards Limited

( * ) Notice: Subject to any disclaimer, the term of this patent is extended or adjusted under 35 U.S.C. 154(b) by 0 days.

(21) Appl. No.: 18/848,365

(22) PCT Filed: Mar. 30, 2023

(86) PCT No.: PCT/GB2023/050826
§ 371 (c)(1),
(2) Date: Sep. 18, 2024

(87) PCT Pub. No.: WO2023/187379
PCT Pub. Date: Oct. 5, 2023

(65) Prior Publication Data

US 2025/0207587 A1 Jun. 26, 2025

(30) Foreign Application Priority Data

Mar. 30, 2022 (GB) ..... 2204519

(51) Int. Cl.
*F04C 18/02* (2006.01)
*F04C 29/00* (2006.01)

(52) U.S. Cl.
CPC ..... *F04C 18/0215* (2013.01); *F04C 29/005* (2013.01); *F04C 2220/10* (2013.01); *F04C 2240/52* (2013.01)

(58) Field of Classification Search
CPC ..... F04C 18/0215; F04C 29/005; F04C 2220/10; F04C 2240/52
See application file for complete search history.

(56) References Cited

U.S. PATENT DOCUMENTS 4,178,143 A * 12/1979 Thelen ..... F04C 15/0034 418/188
5,713,731 A * 2/1998 Utter ..... F04C 18/023 418/55.6
9,360,013 B2 * 6/2016 Forni ..... F01C 19/08
12,173,707 B2 * 12/2024 Holbrook ..... F04C 27/001
(Continued)

FOREIGN PATENT DOCUMENTS

GB 2521682 A 7/2015
GB 2583371 A 10/2020
(Continued)

OTHER PUBLICATIONS

British Combined Search and Examination Report dated Sep. 22, 2022 and Search dated Sep. 21, 2022 for British application Serial No. GB2204519.9, 6 pages.
(Continued)

*Primary Examiner* — J. Todd Newton
(74) *Attorney, Agent, or Firm* — Theodore M. Magee; Westman, Champlin & Koehler, P.A.

(57) ABSTRACT

A non-contacting scroll pump (100) comprising an orbiting scroll (130), a fixed scroll (120), a drive shaft (140) coupled to the orbiting scroll, wherein the drive shaft is movable relative to the fixed scroll in an axial direction. The non-contacting scroll pump further comprises an annular bearing (160*b*) extending around the drive shaft for supporting and facilitating rotation of the drive shaft, and a diaphragm (180) attached to the annular bearing to support the annular bearing, wherein the diaphragm is flexible in the axial direction to allow the annular bearing to move in the axial direction, thereby facilitating the movability of the drive shaft relative to the fixed scroll in the axial direction.

11 Claims, 6 Drawing Sheets

(56) References Cited

U.S. PATENT DOCUMENTS

| | | | | |
|---|---|---|---|---|
| 2014/0271242 | A1* | 9/2014 | Calhoun | F04C 15/0057 417/363 |
| 2014/0271305 | A1* | 9/2014 | Forni | F04C 2/025 418/55.3 |
| 2014/0294640 | A1* | 10/2014 | Calhoun | F04C 18/0284 418/5 |
| 2015/0152866 | A1* | 6/2015 | Forni | F04C 18/0215 418/55.1 |
| 2015/0159650 | A1 | 6/2015 | Forni | |
| 2021/0062808 | A1 | 3/2021 | Hattori et al. | |
| 2022/0299027 | A1* | 9/2022 | Holbrook | F04C 29/0057 |

FOREIGN PATENT DOCUMENTS

| | | | |
|---|---|---|---|
| GB | 2592657 | A | 9/2021 |
| JP | 2016070224 | A | 5/2016 |
| KR | 20040057683 | A | 7/2004 |
| WO | 0238960 | A1 | 5/2002 |
| WO | 2016056172 | A1 | 4/2016 |

OTHER PUBLICATIONS

PCT Notification of Transmittal of the International Search Report and the Written Opinion of the International Searching Authority, or the Declaration dated Aug. 21, 2023 for PCT application Serial No. PCT/GB2023/050826, 7 pages.

PCT Written Opinion of the International Searching Authority dated Aug. 21, 2023 for PCT application Serial No. PCT/GB2023/050826, 8 pages.

* cited by examiner

SCROLL PUMP WITH BEARING DIAPHRAGM

CROSS-REFERENCE OF RELATED APPLICATION

This application is a Section 371 National Stage Application of International Application No. PCT/GB2023/050826, filed Mar. 30, 2023, and published as WO 2023/187379 A1 on Oct. 5, 2023, the content of which is hereby incorporated by reference in its entirety and which claims priority of British Application No. 2204519.9, filed Mar. 30, 2022.

FIELD

The present invention relates to scroll pumps.

BACKGROUND

Scroll pumps are a known type of pump used in various different industries to pump fluid. Scroll pumps operate by using the relative motion of two intermeshed scrolls (known as a fixed scroll and an orbiting scroll) to pump fluid. Each of the fixed and orbiting scrolls includes a spiral wall extending from a base.

One type of scroll pump is a non-contacting scroll pump. In a non-contacting scroll pump, there is no contact between the tip (i.e. the end of the spiral wall) of each of the fixed and orbiting scrolls and the other scroll. Furthermore, in a non-contacting scroll pump, there is no tip seal between the tip of each of the fixed and orbiting scrolls and the other scroll. Therefore, in non-contacting scrolls pumps, there is a small gap (or clearance), e.g. of 10-20 microns, between the tip of each of the fixed and orbiting scrolls and the other scroll.

The discussion above is merely provided for general background information and is not intended to be used as an aid in determining the scope of the claimed subject matter. The claimed subject matter is not limited to implementations that solve any or all disadvantages noted in the background.

SUMMARY

In an aspect of the invention, there is provided a non-contacting scroll pump comprising an orbiting scroll, a fixed scroll, a drive shaft coupled to the orbiting scroll, wherein the drive shaft is movable relative to the fixed scroll in an axial direction. The non-contacting scroll pump further comprises an annular bearing extending around the drive-shaft for supporting and facilitating rotation of the drive shaft, and a diaphragm attached to the annular bearing to support the annular bearing, wherein the diaphragm is flexible in the axial direction to allow the annular bearing to move in the axial direction, thereby facilitating the movability of the drive shaft relative to the fixed scroll in the axial direction.

The diaphragm may be stiff in a radial direction to oppose movement of the annular bearing in the radial direction.

The diaphragm may mechanically couple the annular bearing to the fixed scroll.

The diaphragm may mechanically couple the annular bearing to a housing portion of the non-contacting scroll pump.

The non-contacting scroll pump may comprise a first annular bearing and a second annular bearing, wherein both the first and second annular bearings extend around the drive shaft to support and facilitate rotation of the drive shaft.

The diaphragm may mechanically couple the first annular bearing to the fixed scroll, and the second annular bearing may be mechanically coupled to a housing portion of the non-contacting scroll pump such that the second annular bearing is able to slide in the axial direction relative to the housing portion, thereby facilitating the movability of the drive shaft relative to the fixed scroll in the axial direction.

The diaphragm may mechanically couple the first annular bearing to the fixed scroll, and the second annular bearing may be mechanically coupled to a housing portion of the non-contacting scroll pump by a further diaphragm attached to the second annular bearing to support the second annular bearing, wherein the further diaphragm is flexible in the axial direction to allow the second annular bearing to move in the axial direction, thereby facilitating the movability of the drive shaft relative to the fixed scroll in the axial direction.

The further diaphragm may be stiff in the radial direction to oppose movement of the second annular bearing in the radial direction.

The diaphragm may be formed from steel or aluminium.

The non-contacting scroll pump may further comprise a preload spring arranged to provide a preloading force on the drive shaft which acts to bias the orbiting scroll away from the fixed scroll.

In another aspect of the invention, there is provided a non-contacting scroll pump comprising a fixed scroll, an orbiting scroll intermeshed with the fixed scroll, an annular bearing coupled to the orbiting scroll, a crank sleeve coupled to the annular bearing, and a drive shaft coupled to the crank sleeve. The drive shaft is arranged to drive orbiting of the orbiting scroll via the crank sleeve and the annular bearing. The crank sleeve is axially movable relative to the drive shaft, thereby allowing axial movement of the orbiting scroll relative to the fixed scroll.

The non-contacting scroll pump may further comprise a biasing mechanism arranged to provide an axial biasing force on the crank sleeve which acts through the crank sleeve and the annular bearing to bias the orbiting scroll away from the fixed scroll.

The biasing mechanism may be a preload spring.

In another aspect of the invention, there is provided a vacuum pumping system comprising a plurality of vacuum pumps, wherein one of the vacuum pumps is the non-contacting scroll pump of the above aspect.

In yet another aspect of the invention, there is provided the use of the non-contacting scroll pump of any of the above aspects to pump fluid.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

Figure 1:
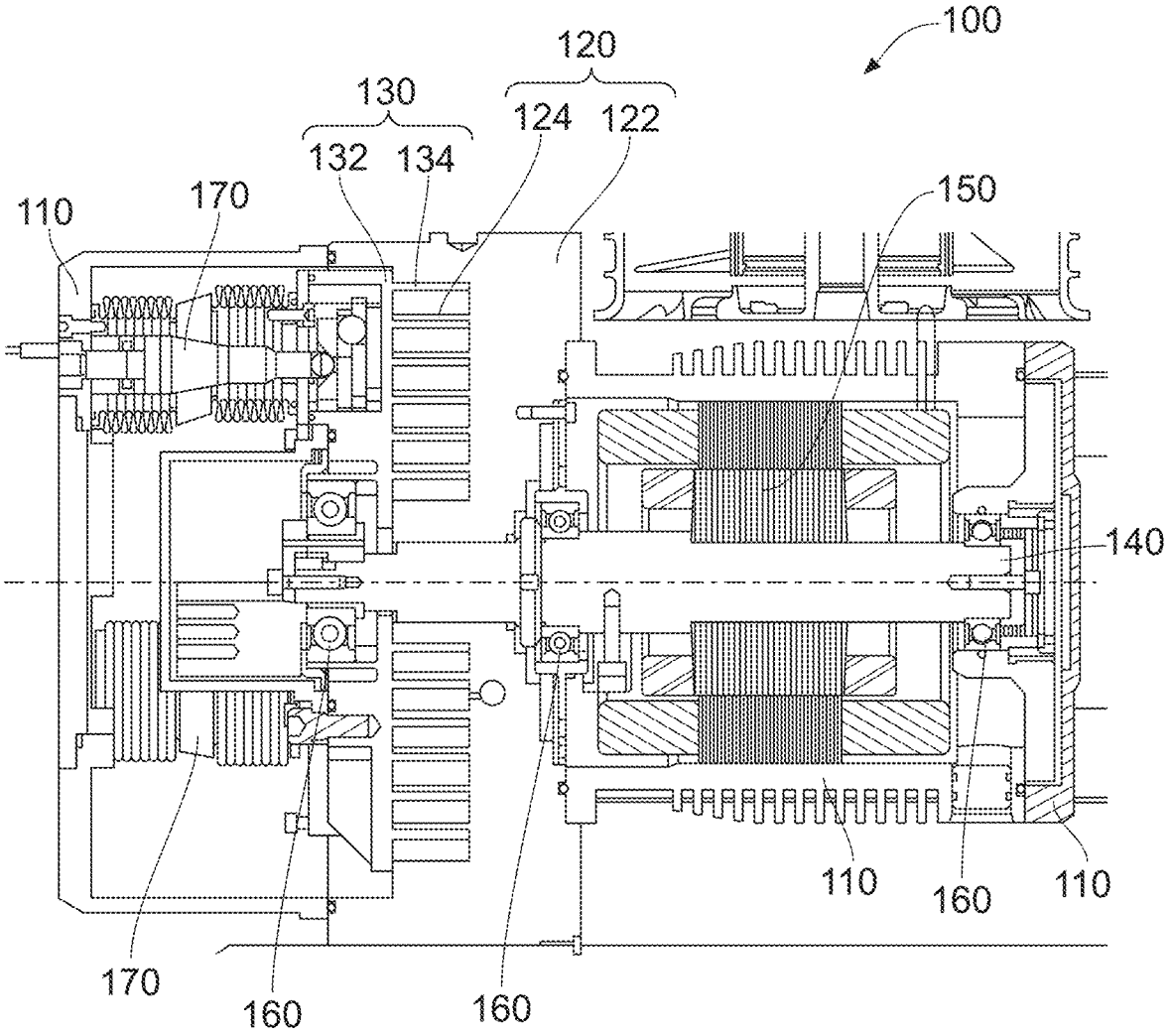
FIG. 1 is a schematic illustration (not to scale) showing a cross-sectional view of a non-contacting scroll pump.

FIG. 1 is a schematic illustration (not to scale) showing a cross-sectional view of a non-contacting scroll pump 100.

The scroll pump 100 comprises housing portions 110, a fixed scroll 120, an orbiting scroll 130, a drive shaft 140, an actuator 150, a main bearing assembly 160, and a plurality of thrust bearing assemblies 170.

In this embodiment, the housing portions 110 and the fixed scroll 120 together define an overall housing of the scroll pump 100 within which other components of the scroll pump 100 are located. However, it will be appreciated that, in other embodiments, the fixed scroll 120 may not define any of the overall housing of the scroll pump 100 and instead may be located entirely within an overall housing. In this embodiment, the orbiting scroll 130 is located within the overall housing of the scroll pump 100.

The orbiting scroll 130 is intermeshed with the fixed scroll 120 to define a space (or channel) which is used by the scroll pump 100 during operation to pump fluid (e.g. a gas). The orbiting scroll 130 is configured to orbit relative to the fixed scroll 120 to pump fluid from an inlet (not shown) of the scroll pump 100 to an outlet (not shown) of the scroll pump 100. The precise physical mechanism by which fluid is pumped by the orbiting of the orbiting scroll 130 relative to the fixed scroll 120 is well understood and will not be described herein for the sake of brevity.

The fixed scroll 120 comprises a first base 122 and a first spiral wall 124. The orbiting scroll 130 comprises a second base 132 and a second spiral wall 134. The first spiral wall 124 and second spiral wall 134 are intermeshed with each other. Furthermore, the first spiral wall 124 extends perpendicularly from the first base 122 towards the second base 132 such that an end surface (also known as the tip) of the first spiral wall 124 is proximate to (e.g. 10-20 microns away) but not in contact with an opposing surface of the second base 132. The second spiral wall 134 extends perpendicularly from the second base 132 towards the first base 122 such that an end surface (or tip) of the second spiral wall 134 is proximate to (e.g. 10-20 microns away) but not in contact with an opposing surface of the first base 122. Thus, there is a gap or clearance (e.g. of 10-20 microns) between the end surfaces of the first and second spiral walls 124, 134 the respective opposing surfaces of the first and second bases 122, 132. The distance between the end surface of the first spiral wall 124 and the opposing surface of the second base 132 is the same as the distance between the second spiral wall 134 and the opposing surface of the first base 122. The gaps are empty in the sense that there are no objects or other scroll pump parts located within the gaps. For example, there are no tip seals within the gaps. Accordingly, the end surfaces of the first and second spiral walls 124, 134 are not in contact with any objects or other scroll pump parts.

In this embodiment, the first base 122 and first spiral wall 124 are integrally formed with each other, and the second base 132 and second spiral wall 134 are integrally formed with each other. However, in other embodiments, one or both of the spiral walls 124, 134 are not integrally formed with their respective bases 122, 132.

The drive shaft 140 is coupled to the orbiting scroll 130 and configured to rotate to drive the orbiting of the orbiting scroll 130. The drive shaft 140 is located within the overall housing of the scroll pump 100 and mounted via the main bearing assembly 160 which facilitates rotation of the drive shaft 140. In this embodiment, the drive shaft 140 extends through both the fixed scroll 120 and the orbiting scroll 130, and the orbiting scroll 130 is mounted at an end of the drive shaft 140.

The actuator 150 (e.g. an electric motor) is coupled to the drive shaft 140 and configured to actuate the drive shaft 140 to cause the drive shaft 140 to rotate to drive the orbiting of the orbiting scroll 130. The actuator 150 is located within the overall housing of the scroll pump 100 and mounted around the drive shaft 140.

The main bearing assembly 160 mechanically couples the drive shaft 140 to the orbiting scroll 130 and the overall housing of the scroll pump 100 such that the drive shaft 140 is able to rotate within the scroll pump 100 to drive the orbiting scroll 130.

The plurality of thrust bearing assemblies 170 are each located between the orbiting scroll 130 and a housing portion 110 which is axially spaced apart from the orbiting scroll 130. Each thrust bearing assembly 170 is coupled to (and engaged with) the orbiting scroll 130 to constrain and/or control the axial position of the orbiting scroll 130 relative to the fixed scroll 120. In this embodiment, there are three thrust bearing assemblies 170 evenly angularly distributed around the central rotation axis of the orbiting scroll in a triangular formation to provide a stable axial force on the orbiting scroll 130 (this is illustrated further in FIG. 3). The precise structure of each of the thrust bearing assemblies will be described in more detail with reference to FIG. 2.

Figure 2:
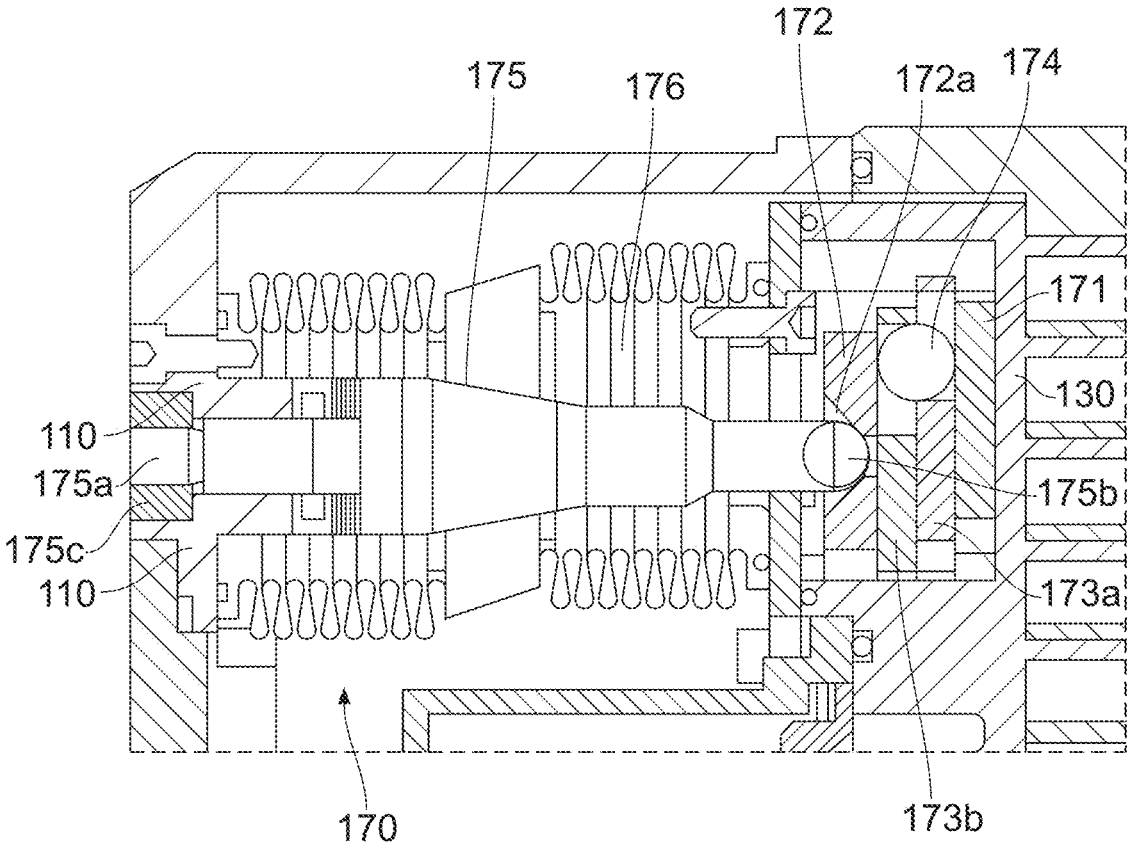
FIG. 2 is a schematic illustration (not to scale) showing a close-up cross-sectional view of a thrust bearing assembly of the non-contacting scroll pump.

FIG. 2 is a schematic illustration (not to scale) showing a close-up cross-sectional view of a thrust bearing assembly 170 of the non-contacting scroll pump 100.

The thrust bearing assembly 170 comprises a first plate 171, a second plate 172, a first ball bearing cage **173*a*, a second ball bearing cage 173*b*, a plurality of ball bearings 174, an adjustment pin 175, and a casing 176. Via these structures, the thrust bearing assembly 170 provides axial support to the orbiting scroll 130 while also facilitating the orbiting of the orbiting scroll 130** during operation, as will be described in more detail below.

The first and second plates 171, 172 each have a first side facing towards the orbiting scroll 130 and a second side opposite to the first side facing away from the orbiting scroll 130. The first and second ball bearing cages **173*a*, 173*b* also each have a first side facing towards the orbiting scroll 130 and a second side opposite to the first side facing away from the orbiting scroll 130. The first side of the first plate 171 is fixed to a back surface of the orbiting scroll 130, and the second side of the first plate 171 is fixed to the first side of the first ball bearing cage 173*a*. The second side of the first ball bearing cage 173*a* is spaced apart from the first side of the second ball bearing cage 173*b* by the ball bearings 174, thereby allowing relative motion of the first and second ball bearing cages 173*a*, 173*b*. The second side of the second ball bearing cage 173*b* is fixed to the first side of the second plate 172. The second side of the second plate 172 is engaged with an end of the adjustment pin 175**.

The first and second ball bearing cages **173*a*, 173*b* each comprise a plurality of holes within which the plurality of ball bearings 174 are located. Each hole of the first ball bearing cage 173***a* partially overlaps with a corresponding hole of the second ball bearing cage 173*b* to form a plurality of hole pairs. Each hole pair houses a single ball bearing 174. The partial overlap of the holes enables the first and second bearing cages 173*a*, 173*b* to accommodate the orbiting motion of the orbiting scroll 130 during operation while constraining the movement of the ball bearings 174. This is illustrated further in FIG. 4.

The plurality of ball bearings 174 are sandwiched between the first and second plates 171, 172 such that each of the first and second plates 171, 172 are in contact with the ball bearings 174. Each ball bearing 174 of the plurality of ball bearings 174 is housed within a respective hole pair of the first and second ball bearing cages 173*a*, 173*b*. The plurality of ball bearings 174 may be formed from steel or ceramic.

During operation, to facilitate the orbiting of the orbiting scroll 130, the plurality of ball bearings 174 roll against the first and second plates 171, 172 within the hole pairs of the first and second ball bearing cages 173*a*, 173*b*. During operation of the scroll pump 100, the first plate 171 and first ball bearing cage 173*a*, which are fixed to each other and to the orbiting scroll 130, move together with the orbiting scroll 130. Thus, during operation, the first plate 171, first ball bearing cage 173*a* and orbiting scroll 130 all move together relative to the second plate 172 and the second ball bearing cage 173*b* on the plurality of ball bearings 174.

The adjustment pin 175 extends axially between a housing portion 110 of the scroll pump 100 and the second plate 172. A first end 175*a* of the adjustment pin 175 is attached to the housing portion 110, and a second end 175*b* opposite to the first end 175*a* of the adjustment pin 175 is engaged with the second side of the second plate 172. The first end 175*a* of the adjustment pin 175 is threaded and coupled to the housing portion 110 via a corresponding threaded nut 175*c*. The threaded nut 175*c* is at the first end 175*a* of the adjustment pin 175 and is rotatable on the threading of the first end 175*a* to adjust the axial position of the adjustment pin 175, thereby facilitating control of the axial position of the orbiting scroll 130 via the rest of the thrust bearing assembly 170.

The second end 175*b* of the adjustment pin 175 sits in a tapered recess 172*a* in the second side of the second plate 172. The tapered recess 172*a* has a generally conical shape. More specifically, the second end 175*b* of the adjustment pin 175 comprises a rounded surface which is engaged with a surface of the second side of the second plate 172 which defines the tapered recess 172*a*. In this way, the rounded surface of the second end 175*b* of the adjustment pin 175 and the surface defining the tapered recess 172*a* together form a ball and socket joint, which enables the second plate 172 and second ball bearing cage 173*b* to articulate/rotate on the first end 175*b* of the adjusting pin 175.

The casing 176 surrounds the adjustment pin 175 and acts as a barrier to prevent escape of lubricant (e.g. oil or grease) used for the ball bearings 174, the first and second bearing cages 173*a*, 173*b*, and the first and second plates 171, 172. In this embodiment, the casing 176 has a bellows shape.

Figure 3:
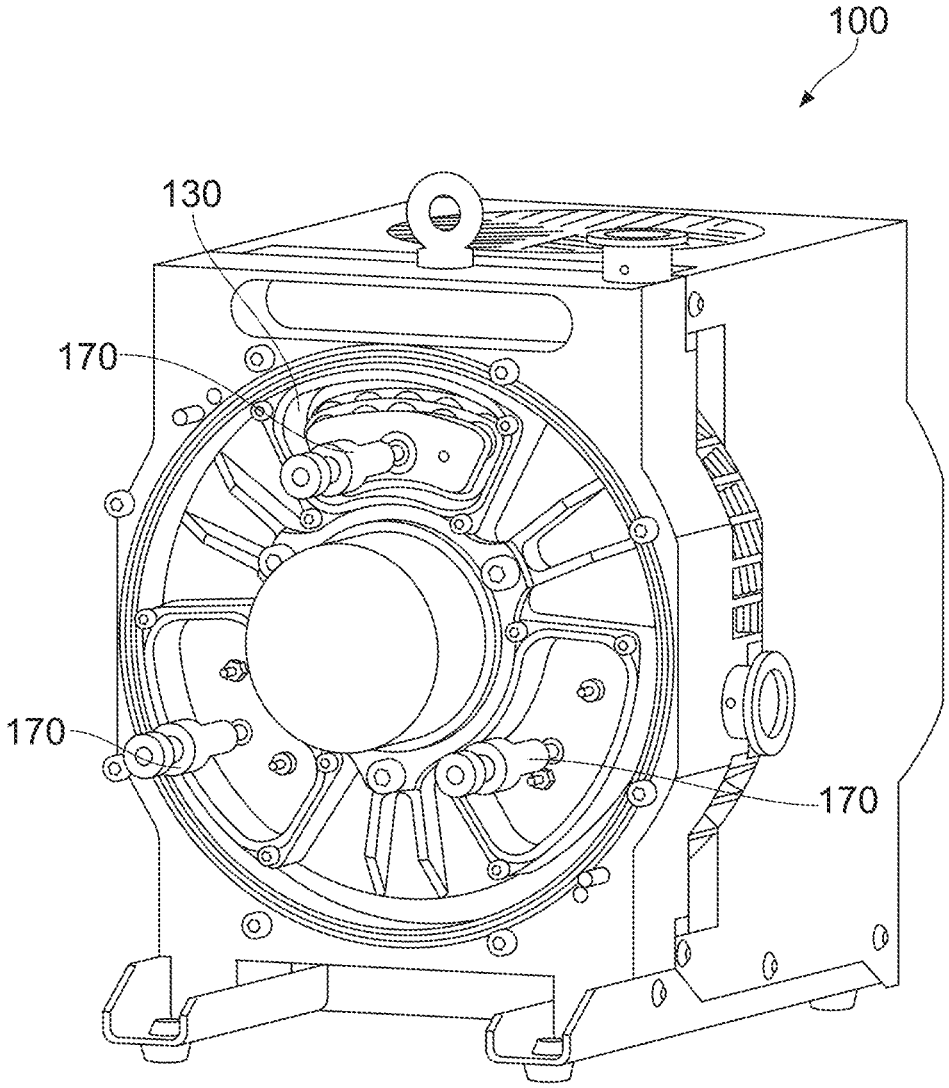
FIG. 3 is a schematic illustration (not to scale) showing a perspective view of a plurality of thrust bearing assemblies of the non-contacting scroll pump.

FIG. 3 is a schematic illustration (not to scale) showing a perspective view of the plurality of thrust bearing assemblies 170 of the non-contacting scroll pump 100. As shown, in this embodiment, the scroll pump 100 comprises three thrust bearing assemblies 170 which evenly angularly distributed around the central rotation axis of the orbiting scroll in a triangular formation to provide a stable axial force on the orbiting scroll 130.

Figure 4:
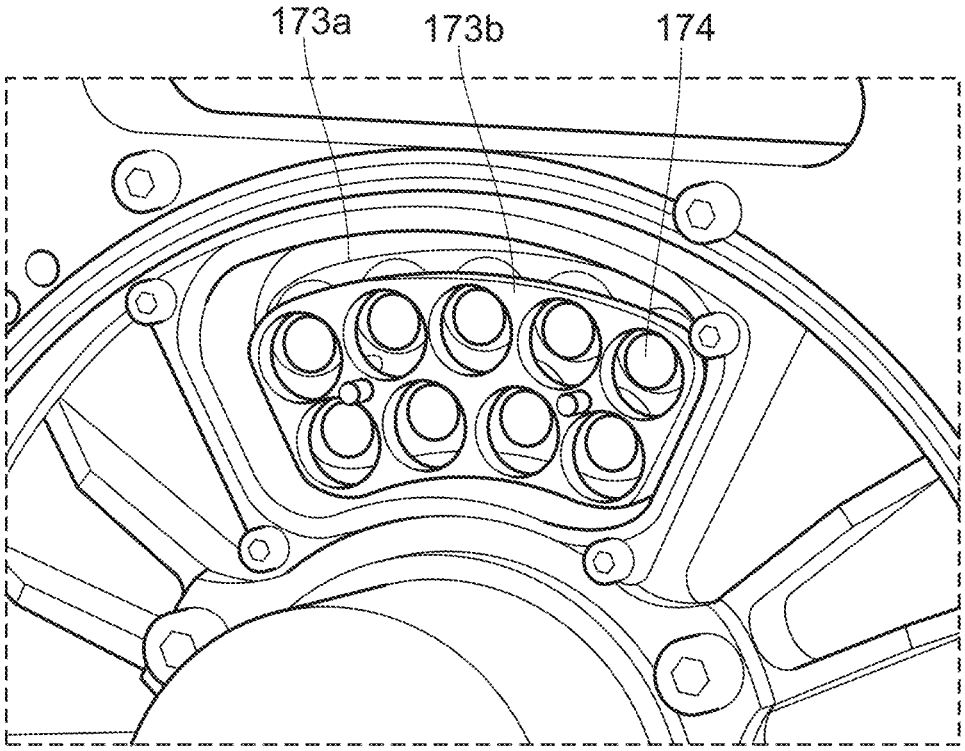
FIG. 4 is a schematic illustration (not to scale) showing a close-up perspective view of part of a thrust bearing assembly of the non-contacting scroll pump.

FIG. 4 is a schematic illustration (not to scale) showing a close-up perspective view of part of a thrust bearing assembly 170 of the non-contacting scroll pump 100. Specifically, FIG. 4 illustrates a close-up view of the first and second bearing cages 173*a*, 173*b* of the thrust bearing assembly 170. As shown, each hole of the first ball bearing cage 173*a* partially overlaps with a corresponding hole of the second ball bearing cage 173*b* to form a plurality of hole pairs. The ball bearings 174 are each located within a respective hole pair (only one ball bearing 174 is labelled in FIG. 4).

Figure 5:
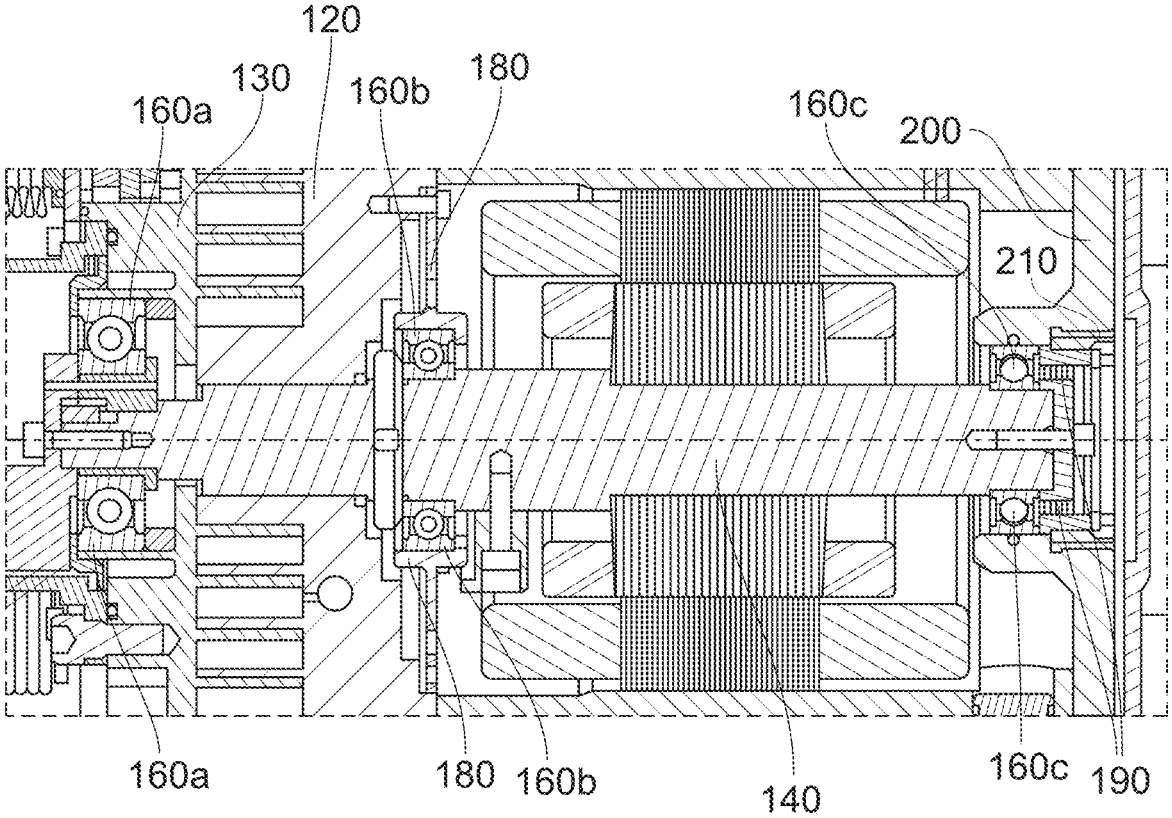
FIG. 5 is a schematic illustration (not to scale) showing a close-up perspective view of part of a main bearing assembly of the non-contacting scroll pump.

FIG. 5 is a schematic illustration (not to scale) showing a close-up cross-sectional view of part of the main bearing assembly 160 of the non-contacting scroll pump 100.

In order to allow for axial movement of the orbiting scroll 130, a mechanism is required which works with the main bearing assembly 160 which supports the drive shaft 140 which drives the orbiting scroll 130. This will now be described with reference to FIG. 5.

In this embodiment, the main bearing assembly 160 comprises a first bearing 160*a*, a second bearing 160*b* and a third bearing 160*c*. The first bearing 160*a*, second bearing 160*b* and third bearing 160*c* are annular bearings extending around the driveshaft 140. The first bearing 160*a* is located between (and mechanically couples) the orbiting scroll 130 and a first end of the drive shaft 140. The second bearing 160*b* is located between (and mechanically couples) the fixed scroll 120 and the drive shaft 140. The second bearing 160*b* is supported by the fixed scroll 120 via a diaphragm 180. The third bearing 160*c* is located between (and mechanically couples) a second end of the drive shaft 140 and the overall housing of the scroll pump 100. The second bearing 160*b* is located between the first bearing 160*a* and the third bearing 160*c* in the axial direction.

The scroll pump 100 comprises a diaphragm 180 located between the second bearing 160*b* and the fixed scroll 120. The diaphragm 180 is attached to and surrounds the second bearing 160*b* to mechanically couples the second bearing 160*b* to the fixed scroll 120. The diaphragm 180 is attached to the fixed scroll 120 at a radially outer periphery of the diaphragm 180. The diaphragm 180 extends circumferentially around the second bearing 160*b* to support the second bearing 160*b* in its position. In other words, the diaphragm 180 comprises a hole and the second bearing 160*b* is located within the hole, while being attached to the diaphragm 180 via an edge of the diaphragm 180 defining the hole. The diaphragm 180 supports the second bearing 160*b* whilst being flexible in the axial direction to allow the second bearing 160*b* to move axially relative to the fixed scroll 120. The diaphragm 180 also has a high radial stiffness in order to oppose and/or prevent the second bearing 160*b* from moving in the radial direction. The diaphragm 180 may be formed from, for example, steel or aluminium.

In this embodiment, the third bearing 160*c* is mounted to a housing portion 200 in a bore in the housing portion 200 such that the third bearing 160*c* is slidable in the axial direction relative to the housing portion 200. This allows the third bearing 160*c* to move axially in the bore relative to the housing portion 200 and the fixed scroll 120. An O-ring is located in the bore around the third bearing 160*c* between the third bearing 160*c* and the housing portion 200 in order to centralise the third bearing 160*c* in the bore and to reduce noise from movement of the third bearing 160*c*. Since both the second bearing 160*b* and the third bearing 160*c* are movable, this allows the driveshaft 140 to move axially, which in turn allows the orbiting scroll 130 to move axially.

In this embodiment, the scroll pump 100 further comprises a preload spring 190 which causes a preloading force to act on the third bearing 160*c*. In this embodiment, the preload spring 190 is located in the axial direction between the third bearing 160*c* and a rear section 210 of the housing. This preloading force acts through the third bearing 160*c* and driveshaft 140 to preload the orbiting scroll 130 in the axial direction away from the fixed scroll 120 and towards the thrust bearing assembly described above. This preloading force, in combination with the axially movability of the driveshaft 140 and thrust bearing assembly, enables a desired axial clearance between the orbiting scroll 130 and the fixed scroll 120 to be maintained consistently and precisely.

Advantageously, the use of the above-described diaphragm 180 tends to avoid the issue of fretting which occurs in other mechanisms for allowing bearings to move axially, e.g. the sliding mechanism described for the third bearing 160*c*.

Advantageously, the use of the above-described diaphragm 180 tends to enable a very precise radial location to be maintained for the orbiting scroll 130, due to the high radial stiffness of the diaphragm 180. The diaphragm 180 eliminates radial movement of the drive shaft 140 in the plane of the second bearing 160*b*, which in turn reduces variation in the radial clearance between the scrolls and allows a smaller radial clearance to be used.

Advantageously, the flexibility of the diaphragm 180 allows the second bearing 160*b* to tilt and fully align with the drive shaft 140. Hence, the third bearing 160*c* and the housing portion 200 can be repositioned by moving them radially, without stressing the second bearing 160*b*.

In a further embodiment (not shown), instead of being supported via the sliding mechanism described above, the third bearing 160*c* is supported by a diaphragm in the same way as the second bearing 160*b*. In other words, in this embodiment, the scroll pump 100 comprises a further diaphragm located between the third bearing 160*c* and the housing portion 200. The further diaphragm is attached to and surrounds the third bearing 160*c* to mechanically couple the third bearing 160*c* to the housing portion 200. The further diaphragm supports the third bearing 160*c* whilst being flexible in the axial direction to allow the third bearing 160*c* to move axially relative to the housing portion 200. The further diaphragm also has a high radial stiffness in order to oppose and/or prevent the third bearing 160*c* from moving in the radial direction.

Figure 6:
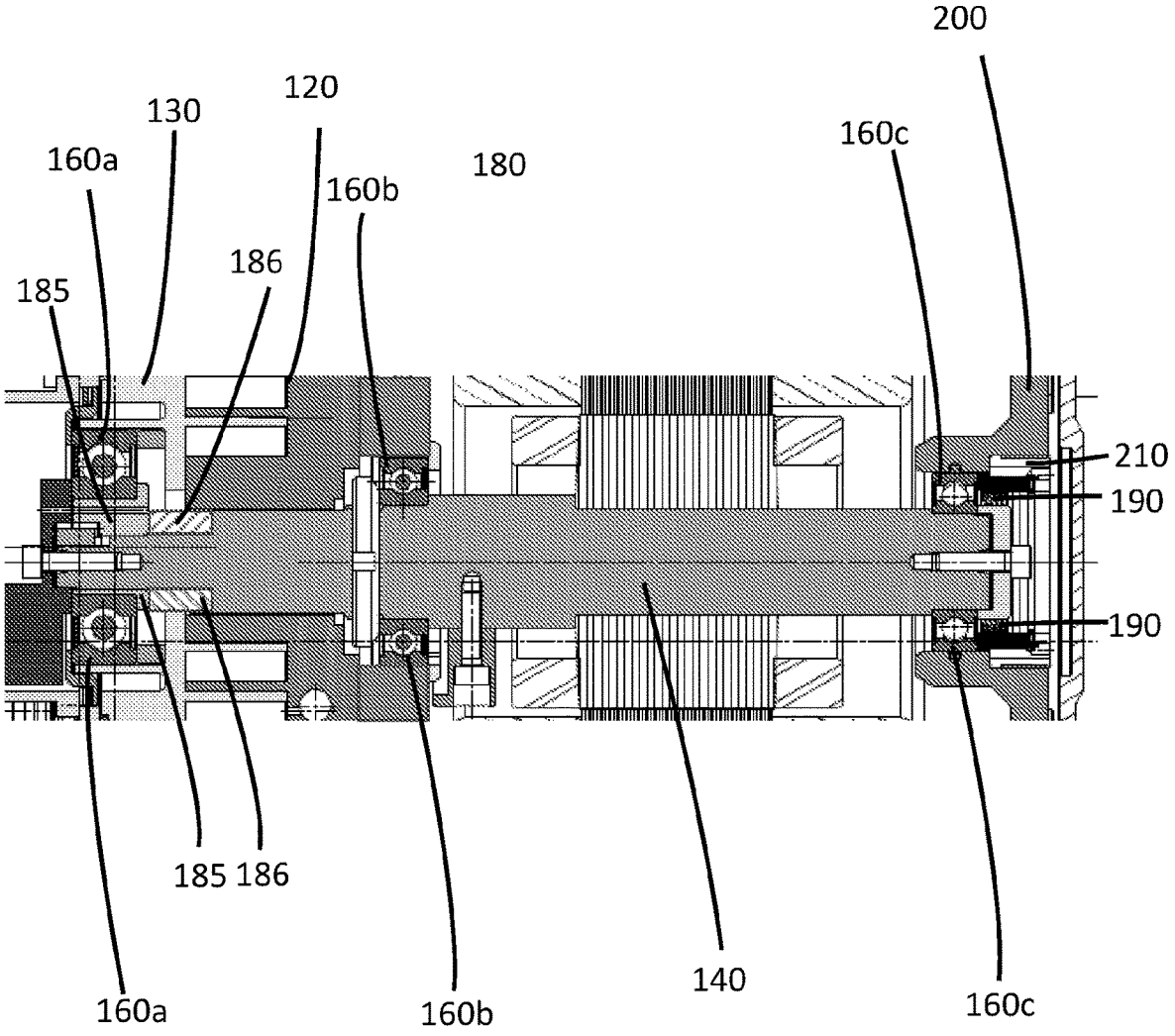
FIG. 6 is a schematic illustration (not to scale) showing a close-up cross-sectional view of part of the non-contacting scroll pump according to another structure.

FIG. 6 is a schematic illustration (not to scale) showing a close-up cross-sectional view of part of the non-contacting scroll pump 100 according to another embodiment.

The embodiment of FIG. 6 is the same as the embodiment of FIG. 5 (with like reference numerals referring to like elements), except that instead of having a diaphragm 180, the scroll pump 100 comprises an axially movable crank sleeve 185 and a biasing mechanism 186 for controlling the axial position of the orbiting scroll 130. In the embodiment of FIG. 6, the second bearing 160*b* is fixed and the first bearing 160*a* is movable.

The crank sleeve 185 is an element present in scroll pumps which provides a crank offset for imparting an orbital path on the orbital scroll 130 of the scroll pump 100. The crank sleeve 185 extends around the drive shaft 140 and is coupled to the orbiting scroll 130 via the first bearing 160*a*. The crank sleeve 185 is an eccentric member with a centre of rotation parallel to, but radially offset from, the axis of rotation of the drive shaft 140 in order to provide the crank offset for the orbiting of the orbiting scroll 130.

In this embodiment, the crank sleeve 185 is axially movable (or slidable) relative to the drive shaft 140 to allow for axial movement of the orbiting scroll 130 relative to the fixed scroll 120. Specifically, the crank sleeve 185 is attached to the first bearing 160*a* and the first bearing 160*a* is attached to the orbiting scroll 130. Thus, axial movement of the crank sleeve 185 causes axial movement of the orbiting scroll 130 via the attachment of the orbiting scroll 130 to the first bearing 160*a* and the attachment of the first bearing 160*a* to the crank sleeve 185.

The biasing mechanism 186 is arranged to provide an axial biasing force on the crank sleeve 185 which acts through the crank sleeve 185 and the first bearing 160*a* to bias the orbiting scroll 130 away from the fixed scroll 120. In this embodiment, the biasing mechanism 186 is a preload spring extending axially between a shoulder portion of the drive shaft 140 and the crank sleeve 185. Since the crank sleeve 185 is axially movable relative the drive shaft 140, a particular biasing force provided by the biasing mechanism 186 can be chosen in order to maintain stability of the orbiting scroll 130 through maintaining a required axial load through each of the plurality of thrust bearing assemblies 170. Thus, a desired axial clearance between the orbiting scroll 130 and the fixed scroll 120 can be maintained.

The above-described non-contacting scroll pump 100 may be used as part of a vacuum pumping system including multiple pumps and/or other components.

It will be appreciated that various modifications/deviations may be made to the above described embodiments without departing from the scope of the invention.

In the above-described embodiments, the scroll pump comprises three separate thrust bearing assemblies. However, in other embodiments, the scroll pump comprises a different number of thrust bearing assemblies, e.g. only one, two or more than 3.

In the above-described embodiments, the thrust bearing assembly comprises a plurality of ball bearings. However, in other embodiments, the thrust bearing assembly comprises only one ball bearing.

In the above-described embodiments, the thrust bearing assembly comprises ball bearing cages to constrain the movement of the ball bearings. However, in other embodiments, the ball bearing cages are omitted.

In the above-described embodiments, an elongate adjustment pin is used to couple the housing to the second plate. However, in other embodiments, a different type of coupling structure may be used, e.g. a different type of elongate member.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A non-contacting scroll pump, comprising:

an orbiting scroll;

a fixed scroll;

a drive shaft coupled to the orbiting scroll, wherein the drive shaft is movable relative to the fixed scroll in an axial direction;

a first annular bearing and a second annular bearing extending around the drive shaft for supporting and facilitating rotation of the drive shaft;

a first diaphragm attached to the first annular bearing to support the first annular bearing, wherein the first diaphragm is flexible in the axial direction to allow the first annular bearing to move in the axial direction, thereby facilitating the movability of the drive shaft relative to the fixed scroll in the axial direction; and a second diaphragm attached to the second annular bearing to support the second annular bearing, wherein the second diaphragm is flexible in the axial direction to allow the second annular bearing to move in the axial direction, thereby facilitating the movability of the drive shaft relative to the fixed scroll in the axial direction.

2. The non-contacting scroll pump of claim 1, wherein the first diaphragm is stiff in a radial direction to oppose movement of the first annular bearing in the radial direction.

3. The non-contacting scroll pump of claim 2, wherein the second diaphragm is stiff in the radial direction to oppose movement of the second annular bearing in the radial direction.

4. The non-contacting scroll pump of claim 1, wherein the first diaphragm mechanically couples the first annular bearing to the fixed scroll.

5. The non-contacting scroll pump of claim 1, wherein the first diaphragm mechanically couples the first annular bearing to a housing portion of the non-contacting scroll pump.

6. The non-contacting scroll pump of claim 1, wherein the first diaphragm is formed from steel or aluminium.

7. The non-contacting scroll pump of claim 1, further comprising a preload spring arranged to provide a preloading force on the drive shaft which acts to bias the orbiting scroll away from the fixed scroll.

8. A non-contacting scroll pump, comprising:

a fixed scroll;

an orbiting scroll intermeshed with the fixed scroll;

an annular bearing coupled to the orbiting scroll;

a crank sleeve coupled to the annular bearing; and a drive shaft coupled to the crank sleeve, wherein the drive shaft is arranged to drive orbiting of the orbiting scroll via the crank sleeve and the annular bearing, and wherein the crank sleeve is axially movable relative to the drive shaft, thereby allowing axial movement of the orbiting scroll relative to the fixed scroll.

9. The non-contacting scroll pump of claim 8, further comprising a biasing mechanism arranged to provide an axial biasing force on the crank sleeve which acts through the crank sleeve and the annular bearing to bias the orbiting scroll away from the fixed scroll.

10. The non-contacting scroll pump of claim 9, wherein the biasing mechanism is a preload spring.

11. The use of the non-contacting scroll pump of claim 1 to pump fluid.

* * * * *